US009624652B2

(12) United States Patent
Clark et al.

(10) Patent No.: US 9,624,652 B2
(45) Date of Patent: Apr. 18, 2017

(54) SYSTEM FOR CONTAMINANT ISOLATION AND FLUSHING

(75) Inventors: Kenneth A. Clark, Chattanooga, TN (US); Nicholaus J. Peyton, Ooltewah, TN (US)

(73) Assignee: Mueller International, LLC, Atlanta, GA (US)

( * ) Notice: Subject to any disclaimer, the term of this patent is extended or adjusted under 35 U.S.C. 154(b) by 833 days.

(21) Appl. No.: 13/216,905

(22) Filed: Aug. 24, 2011

(65) Prior Publication Data

US 2012/0048386 A1 Mar. 1, 2012

Related U.S. Application Data

(60) Provisional application No. 61/376,816, filed on Aug. 25, 2010.

(51) Int. Cl.

| | |
|---|---|
| ***E03B 9/04*** | (2006.01) |
| ***E03B 7/00*** | (2006.01) |
| ***E03B 7/02*** | (2006.01) |
| ***E03B 7/07*** | (2006.01) |

(52) U.S. Cl.

CPC ..... *E03B 9/04* (2013.01); *E03B 7/00* (2013.01); *E03B 7/02* (2013.01); *E03B 7/07* (2013.01); *Y10T 137/0324* (2015.04); *Y10T 137/5485* (2015.04); *Y10T 137/86485* (2015.04)

(58) Field of Classification Search

CPC ... C02F 1/008; C02F 1/76; C02F 1/78; B01D 17/0217; F16K 31/00; E03B 9/02

USPC ..... 210/739; 137/2, 624.27, 299

See application file for complete search history.

(56) References Cited

U.S. PATENT DOCUMENTS

| | | | | |
|---|---|---|---|---|
| 4,561,459 | A | 12/1985 | Jackman | |
| 5,547,164 | A | 8/1996 | Ratnik et al. | |
| 5,646,863 | A | 7/1997 | Morton | |
| 5,788,858 | A * | 8/1998 | Acernese | B01D 61/04 210/202 |
| 6,058,957 | A * | 5/2000 | Honigsbaum | E03B 9/02 137/1 |
| 6,227,463 | B1 | 5/2001 | Porter | |
| 6,245,224 | B1 * | 6/2001 | Enoki | C02F 1/008 137/93 |
| 6,290,908 | B1 | 9/2001 | Fukunaga et al. | |
| 6,753,186 | B2 | 6/2004 | Moskoff | |

(Continued)

FOREIGN PATENT DOCUMENTS

| | | |
|---|---|---|
| DE | 3103126 | 10/1982 |
| WO | 0109041 | 2/2001 |

(Continued)

OTHER PUBLICATIONS

Kenneth, Clark; U.S. Provisional Application entitled: A System for Contaminant Isolation and Flushing having U.S. Appl. No. 61/376,816, filed Aug. 25, 2010, 18 pgs.

(Continued)

*Primary Examiner* — Robert Clemente
*Assistant Examiner* — Akash Varma
(74) *Attorney, Agent, or Firm* — Taylor English Duma LLP

(57) ABSTRACT

A system for isolating and flushing contaminants in a water supply system is disclosed. The system includes a monitoring and detection subsystem, a communication subsystem, and a flushing subsystem. Components of the system for isolating and flushing contaminants may be housed in a hydrant.

20 Claims, 5 Drawing Sheets

(56) References Cited

U.S. PATENT DOCUMENTS

| | | | | |
|---|---|---|---|---|
| 7,110,920 | B2 * | 9/2006 | McCarter et al. | 702/188 |
| 7,459,091 | B2 | 12/2008 | Johnson et al. | |
| 7,520,294 | B2 | 4/2009 | German | |
| 7,866,204 | B2 | 1/2011 | Yang et al. | |
| 8,531,303 | B2 * | 9/2013 | Pham | C02F 1/006 134/43 |
| 2003/0107485 | A1 * | 6/2003 | Zoratti | A62C 31/28 340/568.1 |
| 2004/0197922 | A1 | 10/2004 | Cooper | |
| 2004/0259189 | A1 * | 12/2004 | Marschke | G01N 1/14 435/34 |
| 2007/0090059 | A1 | 4/2007 | Plummer et al. | |
| 2007/0255515 | A1 * | 11/2007 | Hoehner | F17D 5/02 702/51 |
| 2008/0293042 | A1 | 11/2008 | Cooper | |
| 2009/0000666 | A1 | 1/2009 | Peyton | |
| 2010/0156632 | A1 * | 6/2010 | Hyland et al. | 340/540 |
| 2011/0066297 | A1 | 3/2011 | Saberi | |

FOREIGN PATENT DOCUMENTS

| | | | | |
|---|---|---|---|---|
| WO | WO 2008148952 | A2 * | 12/2008 | 340/603 |
| WO | 2010109117 | | 9/2010 | |

OTHER PUBLICATIONS

Clark, Kenneth A.; U.S. Patent Application entitled: A System for Contaminant Isolation and Flushing having U.S. Appl. No. 14/462,023, filed Aug. 18, 2014, 18 pgs.

Clark, Kenneth A.; Non-Final Office Action for U.S. Appl. No. 14/462,023, filed Aug. 18, 2014, mailed Dec. 22, 2014, 26 pgs.

Clark, Kenneth A.; Final Office Action for U.S. Appl. No. 14/462,023, filed Aug. 18, 2014, mailed Jul. 15, 2015, 29 pgs.

Clark, Kenneth A.; Non-Final Office Action for U.S. Appl. No. 14/462,023, filed Aug. 18, 2014, mailed Sep. 23, 2015, 27 pgs.

Clark, Kenneth A.; Final Office Action for U.S. Appl. No. 14/462,023, filed Aug. 18, 2014, mailed Mar. 9, 2016, 34 pgs.

Clark, Kenneth A.; Applicant Interview Summary for U.S. Appl. No. 14/462,023, filed Aug. 18, 2014, mailed Nov. 13, 2015, 3 pgs.

Clark, Kenneth A.; Non-Final Office Action for U.S. Appl. No. 14/462,023, filed Aug. 18, 2014, mailed Jun. 29, 2016, 28 pgs.

Clark, Kenneth A.; Applicant Interview Summary for U.S. Appl. No. 14/462,023, filed Aug. 18, 2014, mailed Nov. 10, 2016, 3 pgs.

Clark, Kenneth A.; Final Office Action for U.S. Appl. No. 14/462,023, filed Aug. 18, 2014; mailed Oct. 6, 2016; 33 pgs.

Clark, Kenneth A.; Notice of Allowance for U.S. Appl. No. 14/462,023, filed Aug. 18, 2014, mailed Feb. 13, 2017, 10 pgs.

* cited by examiner

SYSTEM FOR CONTAMINANT ISOLATION AND FLUSHING

CROSS-REFERENCE TO RELATED APPLICATIONS

This application claims the benefit of U.S. Provisional Application 61/376,816 filed on Aug. 25, 2010, which is hereby incorporated herein in its entirety by reference.

FIELD

The current disclosure is directed to systems and methods of detecting, isolating and flushing contaminants in a water supply system. More particularly the disclosure is directed to systems and methods of identifying, detecting, isolating, and flushing contaminants in a water distribution network utilizing the fire hydrant components of the network.

BACKGROUND

Water supply systems provide potable drinking water to the population and are critical to the maintenance of many essential public services, such as fire suppression. As used in this application a water supply system includes the infrastructure for the collection, transmission, treatment, storage, and distribution of water for homes, commercial establishments, industry, and irrigation, as well as for such public needs as firefighting and street flushing. A typical water supply system includes a water source such as groundwater (aquifers), surface water (lakes and rivers), desalinated saltwater and the like. Untreated water may be transferred using uncovered ground-level aqueducts, covered tunnels or underground water pipes. The water is then purified, and treated. The treated water may be stored in reservoirs such as water tanks or water towers. Pumping stations may be used to provide additional pressure. The pressurized water is then introduced into a water distribution network. The water distribution network is a network of pipes, nodes, pumps, valves, and storage tanks. The water distribution network carries the stored water to the ultimate consumers. Consumers may include private homes, commercial buildings or industrial or institutional facilities and other usage points (such as fire hydrants). The consumer is able to access the water distribution network through a water usage connection (hookup) at the location where the water will be used.

Some water supply systems use Advanced Metering Infrastructure (AMI) systems that measure, collect and analyze information about water usage. An AMI system interacts with devices such as meters and valves through a variety of communication media. AMI systems may include hardware, software, communications, consumer usage displays and controllers, customer associated systems, Meter Data Management (MDM) software, supplier and network distribution business systems, and the like. AMI systems have been used to control shut-off valves to isolate sections of the water supply system during main repair or replacement and for emergency shutoffs.

Interference with the water supply systems could result in serious public health and safety risks. After the terrorist attacks of Sep. 11, 2001 there are heightened concerns about the vulnerabilities of the water supply systems to attack by chemical, microbial, or radiological contamination. Despite the heightened concern, protecting water supply from attack has not been effectively addressed. In the US there are more than 160,000 public water supply systems. The variability of the water supply systems and a lack of financial resources within the water sector have been advanced as obstacles to the implementation of security programs.

Utilities that manage the water supply systems require a detection, isolation and flushing system that can be implemented easily, widely and at an affordable cost. The limited numbers of utilities that are beginning to design contaminant detection systems usually determine sensor placement based on logistical constraints (e.g., available power source, access to communications) and focus on larger pipes that serve the most customers.

The Environmental Protection Agency (EPA) has listed the characteristics necessary for an effective early warning system for monitoring water supply systems. See, "Technologies and Techniques for Early Warning Systems to Monitor and Evaluate Drinking Water Quality: A State-of-the-Art Review" EPA/600/R-05/156 (Aug. 25, 2005). Among those characteristics are rapid response; a significant degree of automation; affordable cost; robustness and ruggedness to continually operate in a water environment; remote operation and adjustment; and continuous operation. The EPA has concluded that a system with those characteristics did not exist and that affordable operation, maintenance, and capital costs were essential.

Infrastructure monitoring systems, such as, for example, "Infrastructure Monitoring System and Method" U.S. application Ser. No. 12/606,957, to Hyland et al (assigned to the assignee of the present application) have been described. The Hyland application describes an infrastructure monitoring system and method that comprises multiple monitoring devices and/or multiple output devices. Each monitoring device includes at least one sensor for collecting data, a data storage device for storing the data, a processor for analyzing the data, and a communications device for transmitting and receiving data. The system may also include an operations center for controlling and receiving data from the devices.

Fire hydrants are an accessible component of a water distribution network. For example, hydrants have been used to monitor system water pressure using pressure gauges and as an access point for leak detection devices to detect and locate leaks. Automatic flushing devices have been attached to hydrants to control chlorination levels.

There is a need for a contaminant detection, isolation, and flushing system for use in a water supply system that requires few changes to the infrastructure that is in place. Furthermore, there is a need for a contaminant detection, isolation, and flushing system that is easy to operate and is affordable. There is a need for a contaminant detection, identification, and flushing system that is scalable depending on the water supply system and threat level. There is also a need for a system capable of flushing contaminants from the water supply once contaminants have been detected, before the contaminated water reaches the users.

SUMMARY

The present disclosure overcomes the problems and disadvantages associated with current approaches and provides new systems and methods of detecting, isolating and flushing contaminants in a water distribution network.

One embodiment of the current disclosure is directed to a method for detecting, isolating, and flushing contaminated water in a municipal water supply system. The method includes testing water flowing through a node in the municipal water supply system at periodic time intervals. The next step is to determine whether the water is contaminated. If the water is contaminated, a signal is sent to a communication facility. The communication facility then instructs the flushing of the system.

Another embodiment is directed to a system for detecting, isolating, and flushing contaminated water in a municipal water supply system. An embodiment of the system includes a monitoring and detection subsystem that tests the water for contaminants. The system also includes a communications subsystem that provides instructions to a flushing subsystem.

Another embodiment is directed to a municipal water supply system. The water supply system includes a water supply, a network of pipes, and water usage connections. The water supply system also includes a flushing subsystem and a contaminant detector that communicates with a communication facility. A control device is provided to activate the flushing device upon receipt of a signal from the communication facility.

Another embodiment is directed to a hydrant having an upper barrel, at least one hose nozzle, and a valve associated with the hose nozzle. An electric motor is provided to open and close the valve. The hydrant also comprises a controller coupled to the hydrant. The controller receives instructions to open the valve when a contaminant has been detected upstream from the hydrant.

BRIEF DESCRIPTION OF THE DRAWINGS

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Described herein is a number of illustrative embodiments of the present disclosure. The disclosed embodiments are merely examples that may be embodied in additional and alternative forms. There is no intent that the disclosure be limited to specific structural and functional details. Rather the intention is that the embodiments described provide a basis for the claims and for teaching one skilled in the art to employ elements of the present disclosure in a variety of possible embodiments.

Figure 1:
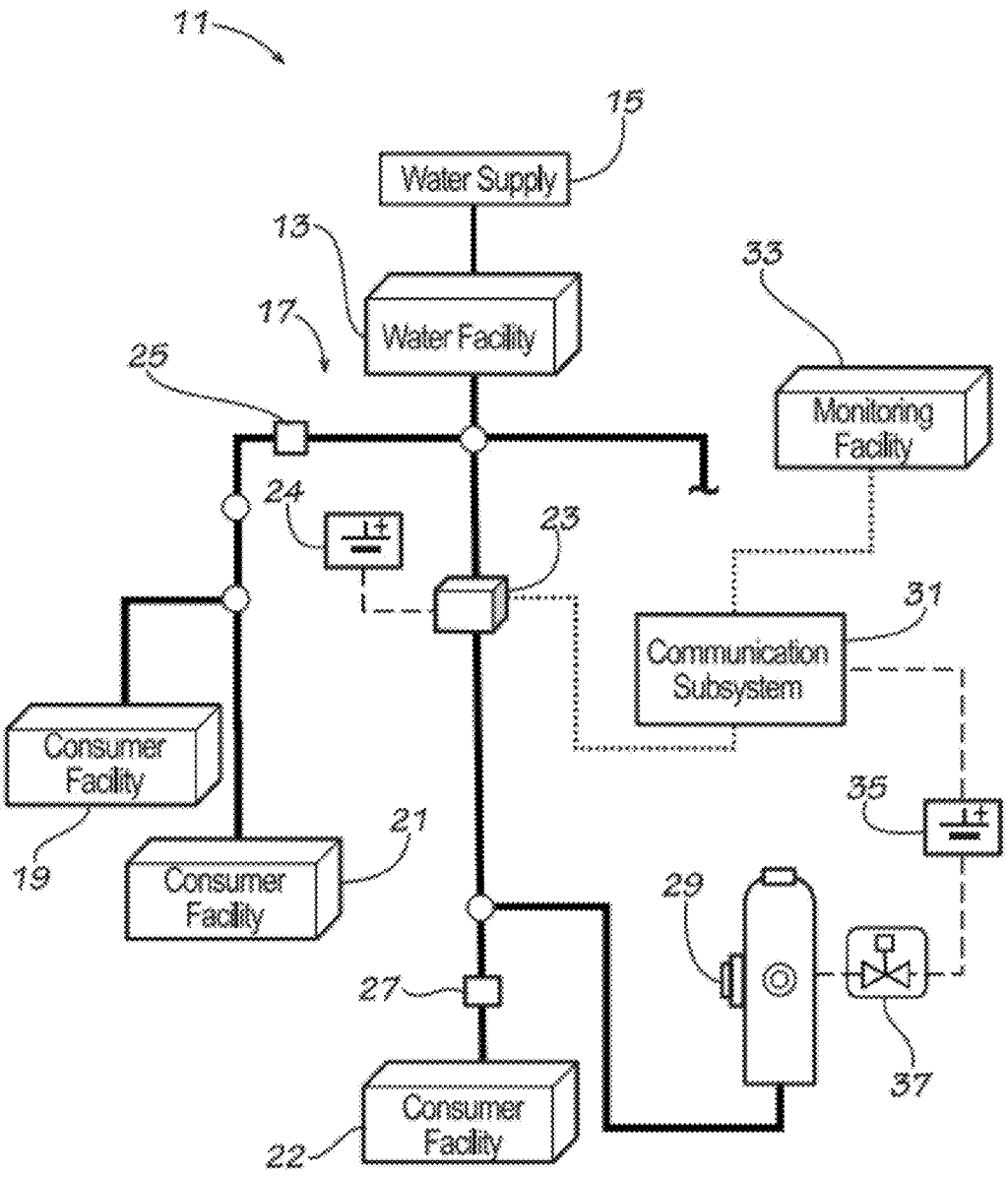
FIG. 1 is an illustration of a water supply system with a system for contaminant detection, isolation, and flushing in accordance with one embodiment of the current disclosure.

Illustrated in FIG. 1 is an example of a contaminant detection, isolation, and flushing system 11 for use in a water supply system. The water supply system includes a water facility 13 that is coupled to a water supply 15. The water facility 13 is connected to a water distribution network 17 that delivers water to consumers such as private homes, commercial buildings, or other facilities generally designated as consumer facilities 19, 21 and 22. A real time monitoring and detection system 23 powered by a power supply 24 is disposed on the water distribution network 17. Power supply 24 may be a battery, a direct connection to power grid, or any other source of electrical power. The water distribution network 17 also includes a number of motorized valves, indicated as 25 and 27, that can be used to control the flow of water through sections of the water distribution network 17. Also coupled to the water distribution network 17 is a hydrant 29. A communications subsystem 31 is provided for receiving data from the monitoring and detection system 23. The data from the communication subsystem 31 is communicated to a monitoring facility 33. The monitoring facility 33 may be centralized or distributed through the area covered by the water supply system. The communication of the data to the monitoring facility 33 may be through wireless communication, an electronic network such as the Internet, or any communication method capable of communicating data. A power supply 35 is provided to power the communications subsystem 31 and to provide power to an actuator 37 connected to a valve in a hydrant 29. The power supply 35 may be any source of electrical power such as a battery or a connection to the electrical grid. The communications subsystem 31 and the actuator 37 may be provided as part of the hydrant 29. Although in the illustration in FIG. 1 a limited number of components are shown, it would be apparent to one of ordinary skill that the number of components such as the monitoring and detection subsystem 23, the hydrant 29, the communications subsystems 31, and the actuator 37 will vary depending on the size of the water supply system and the level of security desired by the operator.

Figure 2:
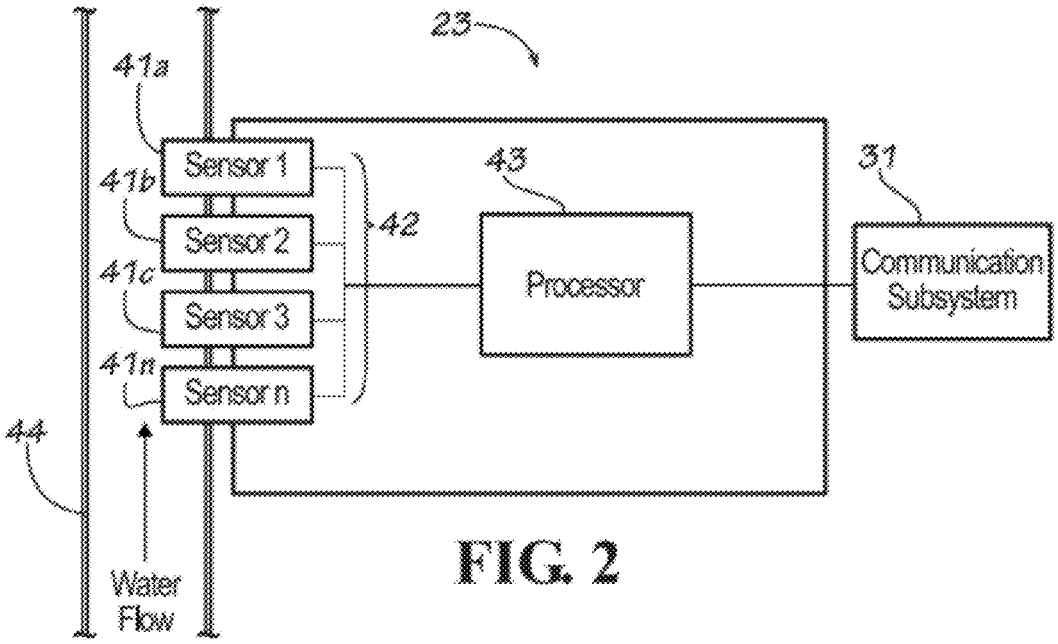
FIG. 2 is an illustration of one embodiment of a monitoring and detection subsystem of the water supply system of FIG. 1.

As illustrated in FIG. 2, the monitoring and detection subsystem 23 includes at least one sensor 41*a,b,c, . . . ,n* or an array of sensors 42 disposed in contact with water flowing through a conduit 44 in the water distribution network 17. The sensors 41 detect a variety of contaminants. Specifically the detection module must be capable of detecting chemical, microbial, and radiological contaminants. A number of technologies exist for the detection of these types of contaminants.

Sensors for detecting chemical contamination may include multi-parameter water quality monitors equipped with additional sensors. There are sensors capable of detecting arsenic, cyanide, and other chemical contaminants. The available sensor technologies include gas chromatography, infrared spectroscopy, X-ray fluorescence, and ion mobility spectroscopy, among others. Sensors utilizing some of these technologies may be incorporated into a microchip.

Sensor technologies are available for detecting microbiological contaminants. Instantaneous microbial detectors (IMD) are capable of detecting instantaneously and in real time airborne or waterborne particles. These sensors enable particulates to be classified by particulate count, size, and biological status. IMD instruments may use light scattering and intrinsic fluorescence to differentiate microbes from inert particles.

Sensors that detect alpha, beta, and gamma radiation are currently in use. The sensors are based on the ability of the radiation to ionize materials or to excite atoms within materials. There are three categories of radiation sensors: gas-filled detectors, scintillation detectors, and semiconductor detectors. Many different types of radiation detectors have been designed and manufactured to produce data corresponding to radioactive materials. Such detectors are in wide use for a variety of applications such as medical imaging and monitoring nuclear waste.

The contaminant monitoring and detection subsystem 23 may include a processor 43 such as a microprocessor for analyzing the output of the sensors 41 and determining whether the water has been contaminated. Upon a determination that the water is contaminated, an output signal from the microprocessor may be communicated to the communication subsystem 31.

Figure 3:
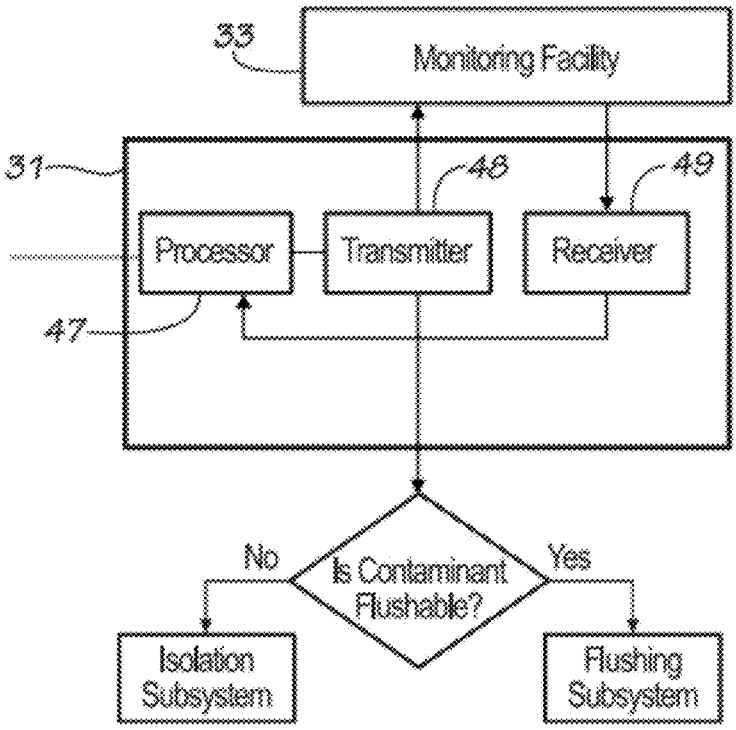
FIG. 3 is an illustration of one embodiment of a communication subsystem of the water supply system of FIG. 1.

FIG. 3 illustrates the major components of an exemplary communication subsystem 31. The communication subsystem 31 may include a processor 47 that receives signals from the monitoring and detection subsystem 23 and communicates a signal to the monitoring facility 33 through transmitter 48. The communication subsystem 31 also may include a receiver 49 that receives instructions from the monitoring facility 33. The instructions may be transmitted to an isolation subsystem and/or a flushing subsystem 100 (described below with reference to FIG. 5).

Figure 4:
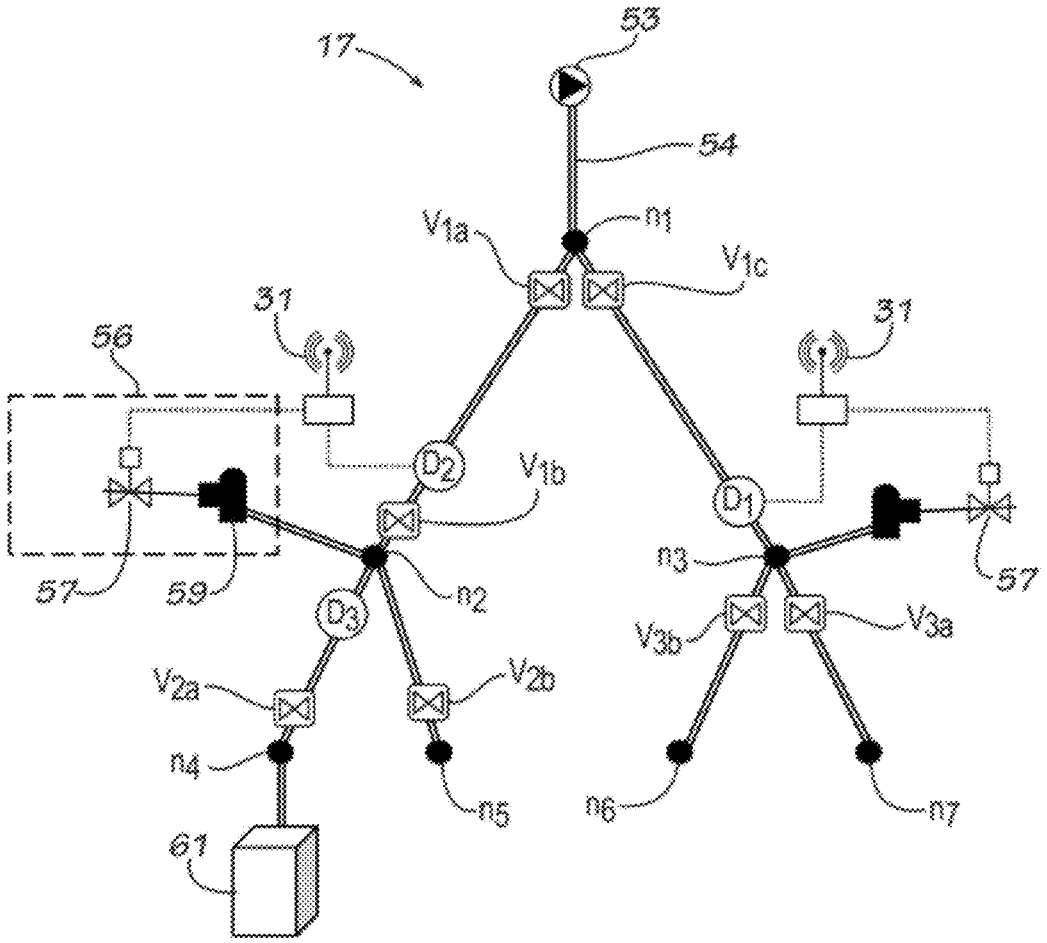
FIG. 4 is an illustration of one embodiment of a branched water distribution network for a water supply system having a contaminant detection, isolation, and flushing system in accordance with one embodiment of the current disclosure.

FIG. 4 illustrates a water distribution network 17 that has been provided with a contaminant detection, isolation, and flushing system in accordance with an embodiment of present disclosure. The water distribution network 17 includes a water source 53, a network of pipes 54 that are connected at nodes n1 through n7. Disposed between each node there may be one or more automated valves illustrated as V1*a* through V3*b*. The automated valves open and close in response to a signal from the monitoring facility 33 (not shown). Also illustrated in FIG. 4 are monitoring and detection subsystems denoted as D1, D2, and D3. The monitoring and detection subsystems D1, D2, and D3 are connected to communications subsystem 31. It should be understood that the connection to the communications subsystem 31 may be hard wired or wireless, depending upon proximity and feasibility of making the connection. Also illustrated in FIG. 4 is a facility 61 that is connected to the water distribution network 17 that may be a target for potential contamination attack.

In operation, if the contaminant monitoring and detection subsystem D2 detects a contaminant, a signal will be communicated to the communications subsystem 31 which in turn will transmit the signal to a monitoring facility 33 (shown in FIG. 1). An assessment will be made at the monitoring facility 33 with regard to the valves that should be closed to isolate the contaminant so that it cannot be propagated further downstream. The monitoring facility 33 will then send a signal to one or more of the automated valves V1*a* through V3*b*. As an example, if a contaminant is introduced somewhere between node n1 and n2, the monitoring and detection subsystem D2 detects the contaminant, and a signal is communicated to the communications subsystem 31 which in turn transmits the signal to the monitoring facility 33 (shown in FIG. 1). An assessment is made at the monitoring facility 33. Upon determining that the contaminant poses a threat, a signal may be transmitted to valve V2*a* instructing the valve V2*a* to close. In some cases, an upstream valve such as valve V1*a* may also be closed.

Also illustrated in FIG. 4 is a flushing subsystem 56. The flushing subsystem 56 includes an automated valve 57 disposed in a device 59 such as a hydrant. The device 59 may be used to flush contaminated water from the water distribution network 17. The flushing subsystem 56 operates in response to instructions from the monitoring facility 33 (shown in FIG. 1) based on the detection of contaminants in sections of the water distribution network 17.

Although the flushing subsystem 56, the isolation subsystem described above, and the communication subsystem 31 have been illustrated and described as separate units, it is contemplated that in a preferred embodiment the flushing subsystem, the communications subsystem 31, and the isolation subsystem may be included in a single device 59 such as a hydrant.

Figure 5:
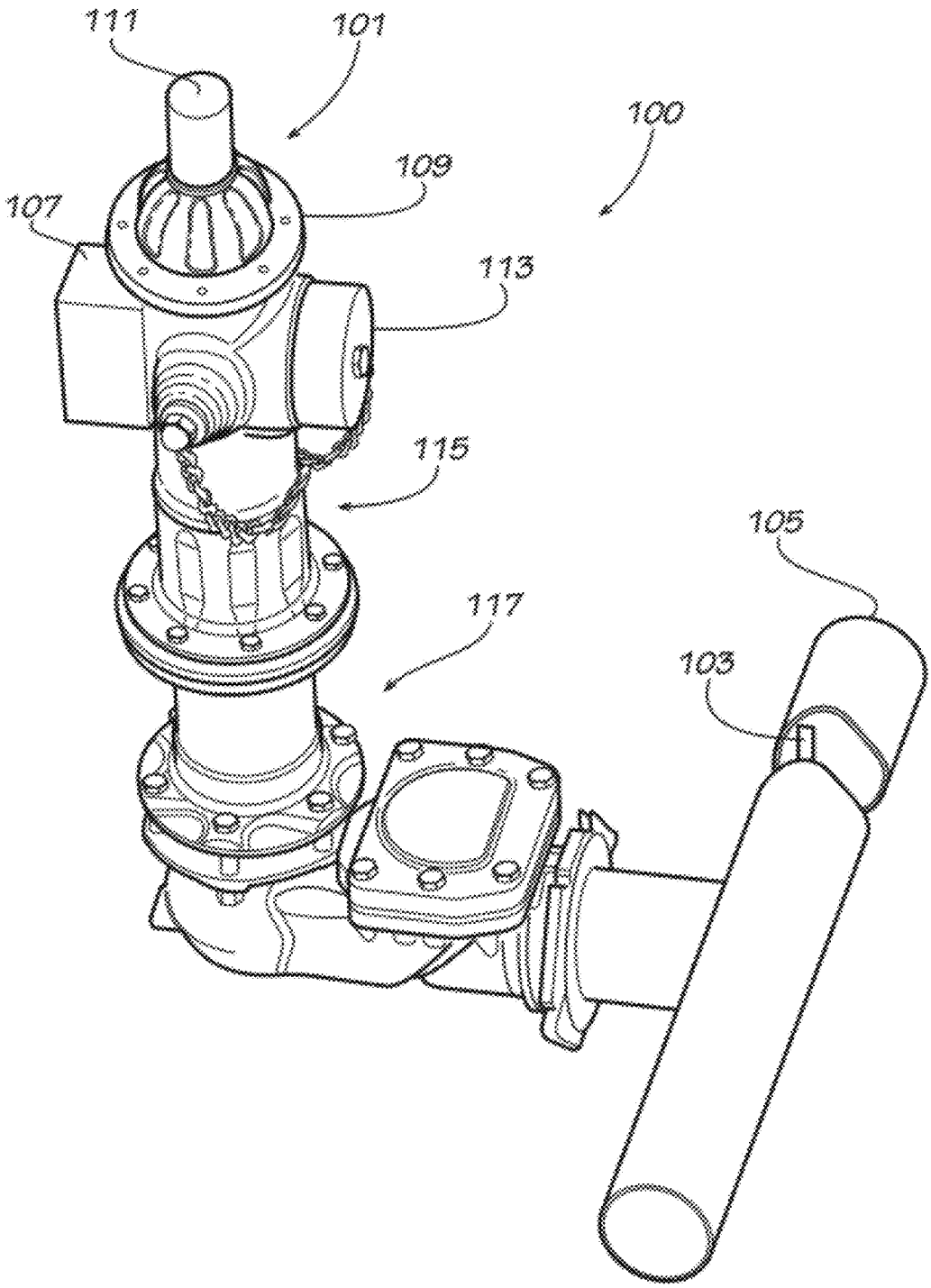
FIG. 5 is an illustration of one embodiment of a flushing subsystem using a hydrant in accordance with one embodiment of the current disclosure.

Illustrated in FIG. 5 is a preferred embodiment where the flushing subsystem 100 is a fire hydrant 101 provided with an automated flushing capability. The hydrant 101 may be linked directly to the monitoring and detection subsystem 23 or networked and controlled by the water supply system operator as part of a larger system. A detection device 103 of a monitoring and detection subsystem 23 may be installed at the hydrant lateral tee 105 on the distribution main. If the installation involves digging, a hard wire may be run up the lateral to the hydrant 101 to provide power to the various subsystems.

The hydrant 101 is provided with a bonnet 109 to house an electric motor 111, override controls, and mounting for an external battery case 107 and AMI components (not shown). The hydrant 101 is provided with a diffuser 113 coupled to an upper barrel 115. The upper barrel 115 may be configured to connect to various existing hydrant buries. An example of one hydrant bury 117 is shown.

A diffuser 113 may be attached to one (or both) hose nozzle(s) of the hydrant to allow the water safely to evacuate to atmosphere and to remove the contaminant from the water distribution network 17. The diffuser 113 is a device that diffuses the water to prevent damage to property that may occur from a solid stream. Some diffusers also dechlorinate water to avoid ground contamination. If required, dechlorination tablets could be contained in the diffuser 113 to meet EPA requirements. The upper stem (not shown) of the hydrant 101 may be designed to accommodate the diversity of upper barrel configurations in use with installed systems. A flexible upper stem design would allow retrofitting of the installed hydrant base in the U.S. The design would allow the use of existing hydrant installations by replacing the upper barrel assembly with the new unit. The modifications to the hydrant 101 will not impede normal firefighter operation. If the system is activated firefighters will be able to shut down the hydrant flushing to utilize the hydrant 101 for standard operation or for other emergency purposes.

When a back flow attack is detected by the in-situ detection device 103 located upstream in the drinking water distribution network 105, the detection device 103 sends a signal through a hard wired line to components of an AMI system. The components of the AMI system may be disposed in the battery case 107 attached to the hydrant 101. The AMI components may be used to send and receive wireless signals to and from the monitoring facility 33.

Figure 6:
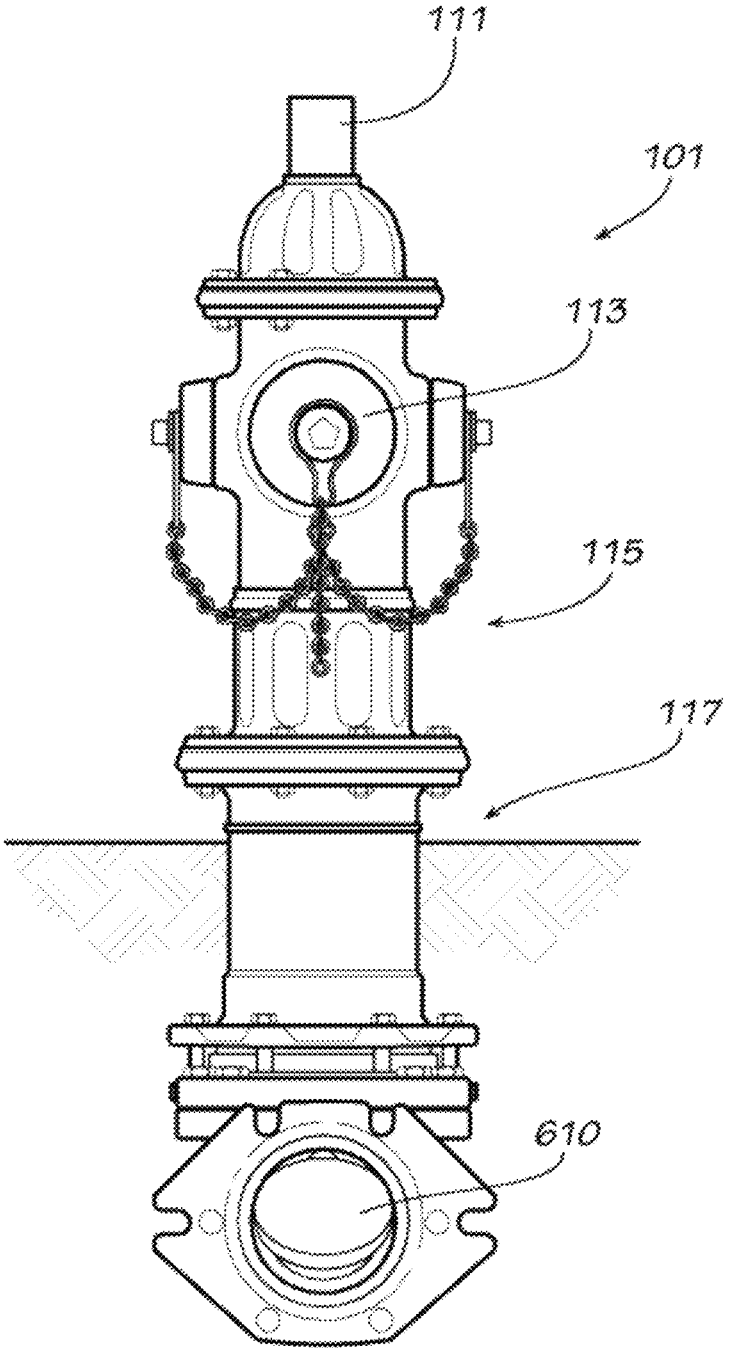
FIG. 6 is a side view of the flushing subsystem of FIG. 5.

With reference to FIGS. 5 and 6, if the monitoring facility 33 determines that a contamination attack has taken place it may provide a signal to the AMI components to activate the electric motor 111 to open the hydrant valve 610 and the flushing diffuser 113 of the hydrant 101. This action would flush the contaminated water outside of the water distribution network 17. The flushed contaminated water may be flushed to the atmosphere, or directly piped to a sewer or drain line. If flushing through the diffuser 113, dechlorination tablets could be contained in the diffuser 113 to meet EPA requirements. In addition, once a contaminant event is detected, the AMI components in the hydrant 101 may be programmed to signal motorized valves (such as V1*a*-V3*b* in FIG. 4) in the water distribution network 17 to close in order to isolate the contaminant.

An element of an AMI system incorporated in the hydrant 101 may alert the water supply system operator of the contamination event and hydrant flushing status and, if so desired, send a message to a message alert company to send automated warning calls to the businesses, residences, etc. within a predetermined radius of the contaminated site. In addition, the AMI system would allow the water supply system operator to override the system and close the hydrant 101 as required.

The water supply system operator may install a flushing subsystem in front of every potential target (e.g. government buildings, military installations schools, hospitals, retirement homes, and other facilities housing population that is most vulnerable to contaminants). Contaminated water may be contained at the scene or in a holding tank. Once the contaminant is identified the contaminated water may be treated to inactivate the contaminant. If dilution of contaminants is a viable approach to inactivation, the contaminated water may be disposed through the sewer system to holding tanks.

Reference to "one embodiment" or "an embodiment" means that a particular feature, structure, or characteristic described in connection with the embodiment may be included in at least one embodiment of the present disclosure. Use of the phrase "in one embodiment" in various places in the specification are not necessarily all referring to the same embodiment, nor are separate or alternative embodiments necessarily mutually exclusive of other embodiments.

For purposes of this description, the terms "couple," "coupling," "coupled," "connect," "connecting," or "connected" refer to any manner known in the art or later developed in which a liquid is allowed to be transferred between two or more elements, and the interposition of one or more additional elements is contemplated, although not required. The terms "directly coupled," "directly connected," etc., imply that the connected elements are either contiguous or connected via a conductor for the transferred liquid.

Other embodiments and uses will be apparent to those skilled in the art from consideration of the specification and practice. All references cited including all publications, U.S. and foreign patents and patent applications, are specifically and entirely incorporated by reference. It is intended that the specification and examples be considered exemplary only with the true scope and spirit of the disclosure indicated by the following claims, furthermore, the term "comprising of" includes the terms "consisting of" and "consisting essentially of." All examples illustrate embodiments but should not be viewed as limiting the scope of the disclosure.

What is claimed:

1. A method for detecting, isolating, and flushing contaminated water in a municipal water supply system utilizing a single device, the method comprising:

receiving, by a communications subsystem, test data of water flowing through a node in the municipal water supply system;

determining whether the water is contaminated based at least in part on the test data;

sending, by the communications subsystem, a first signal to a communication facility if the water is contaminated;

isolating, by an isolation subsystem, the contaminated water by receiving, by the communications subsystem, a second signal including instructions to shut a valve disposed at least one of upstream and downstream from the node if the water is contaminated; and opening a flushing valve of a flushing subsystem to divert the contaminated water out of the water supply system by activating a flushing device with a controller, the flushing device configured to open and close the flushing valve, wherein the single device comprises a casing, the flushing subsystem, the communications subsystem, and the isolation subsystem, wherein the casing is coupled to the single device and houses the controller and the communications subsystem.

2. The method of claim 1, wherein the step of determining whether the water is contaminated comprises determining whether the water has at least one of a chemical contaminant, a microbial contaminant, and a radiological contaminant.

3. The method of claim 1 wherein the communication facility is a monitoring facility.

4. The method of claim 1 further comprising receiving a response signal to open the flushing valve if the water is contaminated.

5. The method of claim 1, wherein the single device is a hydrant.

6. A system for detecting and flushing contaminated water in a municipal water supply system comprising:

at least one device connected to the municipal water supply system;

at least one monitoring and detection subsystem connected to the municipal water supply system to detect contaminated water;

at least one communications subsystem connected to the at least one monitoring and detection subsystem;

at least one flushing subsystem connected to the municipal water supply system, the at least one flushing subsystem comprising a flushing valve and a flushing device configured to open and close the flushing valve, the at least one flushing subsystem responsive to instructions received from the communications subsystem to a controller to flush the contaminated water from the municipal water supply system by activating the flushing device to open the flushing valve; and at least one valve connected to the municipal water supply system, wherein the at least one device comprises a casing, the at least one flushing subsystem, and the at least one communications subsystem, wherein the casing is coupled to the at least one device and houses the controller and the at least one communications subsystem.

7. The system of claim 6 wherein the at least one valve is closed when a contaminant is detected.

8. The system of claim 6 wherein the at least one monitoring and detection subsystem comprises a chemical contaminant detector.

9. The system of claim 6 wherein the at least one monitoring and detection subsystem comprises a microbial detector.

10. The system of claim 6 wherein the at least one monitoring and detection subsystem comprises a radiological detector.

11. The system of claim 6 wherein the at least one device is a hydrant.

12. The system of claim 6 wherein the communications subsystem comprises a wireless transmitter and receiver.

13. The method of claim 1, further comprising determining whether a contaminant contaminating the water is flushable if the water is contaminated.

14. The method of claim 13, further comprising isolating the contaminant in the municipal water supply system if the contaminant is not flushable.

15. The method of claim 13, further comprising flushing the contaminant from the municipal water supply system if the contaminant is flushable.

16. The method of claim 1, wherein the municipal water supply system comprises a monitoring and detection subsystem.

17. The method of claim 16, wherein the monitoring and detection subsystem comprises a chemical contaminant detector.

18. The method of claim 16, wherein the monitoring and detection subsystem comprises a microbial detector.

19. The method of claim 1, wherein the first signal and the second signal comprises a wireless signal.

20. The method of claim 1, wherein the flushing device is an electric motor, and the flushing subsystem comprises the electric motor and a flushing diffuser.

* * * * *